US005840453A

United States Patent [19]

Swidler

[11] Patent Number: 5,840,453

[45] Date of Patent: Nov. 24, 1998

[54] SOLVATION-BASED CHARGE DIRECTION OF ELECTROPHOTOGRAPHIC DEVELOPER COMPOSITIONS

[75] Inventor: Ronald Swidler, Palo Alto, Calif.

[73] Assignee: Colorep, Inc., Sunnyvale, Calif.

[21] Appl. No.: 162,381

[22] Filed: Dec. 3, 1993

Related U.S. Application Data

[63] Continuation of Ser. No. 764,113, Sep. 23, 1991, abandoned, which is a continuation of Ser. No. 582,431, Sep. 13, 1990, abandoned, which is a continuation-in-part of Ser. No. 356,264, May 23, 1989, Pat. No. 5,069,995, which is a continuation-in-part of Ser. No. 464,896, Jan. 16, 1990, Pat. No. 5,411,833, which is a continuation-in-part of Ser. No. 546,044, Jun. 28, 1990, Pat. No. 5,153,090.

[51] Int. Cl.[6] ..... G03G 13/01; G03G 9/13; G03G 9/135

[52] U.S. Cl. ..... 430/42; 430/112; 430/114; 430/115; 430/31

[58] Field of Search ..... 430/112, 114, 430/115, 42, 31

[56] References Cited

U.S. PATENT DOCUMENTS

| | | | |
|---|---|---|---|
| 3,753,760 | 8/1973 | Kosel | 430/112 X |
| 4,062,789 | 12/1977 | Tamai et al. | 430/114 X |
| 4,156,034 | 5/1979 | Mukoh et al. | 430/115 X |
| 4,564,574 | 1/1986 | Uytterhoeven | 430/115 |
| 4,891,286 | 1/1990 | Gibson | 430/115 X |
| 4,925,766 | 5/1990 | Elmasry et al. | 430/115 |
| 4,946,753 | 8/1990 | Elmasry et al. | 430/114 |
| 4,957,844 | 9/1990 | Page | 430/115 |
| 4,971,883 | 11/1990 | Chan et al. | 430/114 |
| 5,034,209 | 7/1991 | Houle et al. | 430/115 |
| 5,153,090 | 10/1992 | Swidler | 430/115 |

FOREIGN PATENT DOCUMENTS

| | | | |
|---|---|---|---|
| 59-87463 | 5/1984 | Japan | 430/115 |
| 1211771 | 8/1989 | Japan | 430/115 |

*Primary Examiner*—Bernard P. Codd
*Attorney, Agent, or Firm*—Corwin R. Horton

[57] ABSTRACT

A solvation-based method for charging toner particles in a liquid electrophotographic developer composition is provided. The method makes use of a material containing specific salvation sites which are incorporated into the resinous phase of the toner, and a charge director which is a metal salt, the metal, cationic component of which is effective to form a highly stable, "solvated" charged toner complex. Toner and developer compositions are also provided which make use of the novel solvation-based mode of charge direction.

32 Claims, No Drawings

SOLVATION-BASED CHARGE DIRECTION OF ELECTROPHOTOGRAPHIC DEVELOPER COMPOSITIONS

This is a continuation of application Ser. No. 07/764,113 filed on Sep. 23, 1991 now abandoned which is a continuation of application Ser. No. 07/582,431, filed 13, Sep. 1990 now abandoned, which is a continuation-in-part of U.S. patent application Ser. No. 07/356,264, filed 23 May 1989, entitled "STAIN ELIMINATION IN CONSECUTIVE COLOR TONING," now U.S. Pat. No. 5,069,995, U.S. patent application Ser. No. 07/464,896, filed 16 Jan. 1990, entitled "ELECTRO-PHOTOGRAPHIC TONER AND DEVELOPER COMPOSITIONS AND COLOR REPRODUCTION PROCESSES USING SAME", now U.S. Pat. No. 5,411,833, and U.S. patent application Ser. No. 07/546,044, filed 28 Jun. 1990, entitled "NOVEL CHARGE DIRECTORS FOR USE IN ELECTROPHOTOGRAPHIC COMPOSITIONS AND PROCESSES" now U.S. Pat. No. 5,153,090. The disclosures of those patent applications are incorporated by reference herein.

TECHNICAL FIELD

The present invention relates generally to the field of color electrophotography, and more particularly relates to an improved method for charge directing liquid electrophotographic developer compositions, and to novel toner and developer compositions produced thereby.

BACKGROUND OF THE INVENTION

Preparation of printed images by electrophotographic, or "xerographic", processes involves coating a selected substrate, or xerographic plate (typically comprised of metal, glass or plastic), with a photoconductive insulating material such as selenium, and then providing an electrostatic charge on the photoconductive surface, e.g., by ionization from a corona discharge. A light image is then focused onto the charged surface, which discharges or lowers the potential of the irradiated areas, while leaving the remainder of the surface charged. The electrostatic image so formed is then made visible by application of a suitable developing composition, which may be in either dry or liquid form.

Conventional liquid developer compositions comprise a dispersion of pigment particles in an insulating carrier liquid. Application of such a composition to the substrate carrying the electrostatic image results in migration of charged pigment particles to the substrate surface and deposition thereon in conformance with the electrostatic image. The developed image is then transferred to another substrate such as paper. (In some cases, it is desirable to eliminate the intermediate step of image transfer, i.e., so that the developed image is directly produced upon the final surface; see, e.g., U.S. Pat. No. 3,052,539 to Greig.)

Liquid developers for use in multicolor image development are relatively recent, and are comprised of colorant embedded in a thermoplastic resin core. These "toner" particles are then dispersed in an insulating carrier medium as above. Like compositions used in black-and-white electrophotography, these developer compositions additionally contain "charge directors", or "charge control agents", to control the charge acquired by the toner particles in the insulating liquid.

When a color image is to be produced electrophotographically, the above-described charging, exposure, and development steps are carried out separately in succession for each of the constituent colors of the image using a correspondingly colored toner. In some color printing processes, each of the color images is transferred from the electrophotographic member to a print substrate after development and prior to formation of the next color image. This process, however, requires extremely accurate registration of the successive color images on the substrate to which they are transferred in order to obtain a high-quality composite image.

Another color printing process, and the process currently in use commercially, is a four-color liquid electrophotographic process known as "consecutive color toning" or "consecutive multicolor image development". This process involves: (1) charging a photoconductive ("pc") surface; (2) impressing a first latent image on the surface by exposure through a colored transparency; (3) developing the image by contacting the pc with a liquid developer composition of a first color, typically yellow; and (4) discharging the pc surface. The steps are then repeated in sequence, typically using magenta, cyan, and black developer compositions, i.e., the cyclic process is repeated until the colored image is complete.

There are a number of problems which are frequently encountered in electrophotographic color processes. These include: toner instability; background staining, i.e., the appearance of toner in uncharged, non-image areas (a problem which is ubiquitous in zinc oxide and other positive toner systems); poor image resolution (i.e., poor edge acuity); poor image density resulting from insufficient deposition of toner particles in intended image regions; and "image" or "character" staining, where a second process color overtones the first image in regions where portions of the first image should have been discharged but were not. An additional problem with current electrophotographic color development processes is the need for multiple washing and drying steps during development, e.g., as described by Alexandrovich et al. in U.S. Pat. No. 4,701,387. The inventors therein propose a solution wherein the developed surface is rinsed with a polar liquid after each development step. It is suggested that application of a polar rinse liquid neutralizes and solvates residual counterions deriving from charge directors and stabilizers present in the liquid developer. The method is somewhat time-consuming and unwieldy (it is recommended in the '387 patent that "after each development step and before the next developer is applied, the developed image is rinsed . . . . After rinsing, the rinse liquid is removed from the photoconductive element by drying, wiping or other method . . . "; see column 2, lines 62–67).

The invention herein now provides a novel method for charge directing liquid electrophotographic developer compositions which addresses the aforementioned problems. The invention is premised on the generation of an extremely stable charge director/toner complex, which in turn provides a very stable developer composition of exceptionally high particle-mediated conductivity and charge. The present method and associated compositions provide for a streamlined development process and enable preparation of a final electrophotographic print of unexpectedly high quality.

BACKGROUND ART

Electrophotographic processing, generally: R. M. Schaffert, Electrophotography (London: Focal Press, 1975), provides a comprehensive overview of electrophotographic processes and techniques. Representative references which relate to the field of color electrophotography, specifically, include U.S. Pat. Nos. 3,060,021 to Greig, 3,253,913 to Smith et al., 3,285,837 to Neber, 3,337,340 to Matkan, 3,553,093 to Putnam et al., 3,672,887 to Matsumoto et al., 3,687,661 to Sato et al., and 3,849,165 to Stahly et al. References which describe electrophotographic toners and developers include U.S. Pat. Nos. 4,659,640 to Santilli (which describes a developer composition containing dispersed wax), 2,986,521 to Wielicki, 3,345,293 to Bartoszewicz et al., 3,406,062 to Michalchik, 3,779,924 to Chechak, and 3,788,995 to Stahly et al.

Charge directors: References which relate to charge directors include U.S. Pat. Nos. 3,012,969 to van der Minne et al. (polyvalent metal organic salts in combination with an oxygen-containing organic compound), 3,411,936 to Rotsman et al. (metallic soaps), 3,417,019 to Beyer (metallic soaps and organic surface active agents), 3,788,995 to Stahly et al. (various polymeric agents), 4,170,563 to Merrill et al. (phosphonates), 4,229,513 (quaternary ammonium polymers), 4,762,764 to Ng (polybutene succinimide, lecithin, basic barium petroleum sulfonates, and mixtures thereof), and *Research Disclosure*, May 1973, at page 66.

Image staining in consecutive color toning: U.S. Pat. No. 4,701,387 to Alexandrovich et al., discussed in the preceding section, and U.S. Pat. No. 3,337,340 to Matkan, are relevant insofar as each of these references relates to the problem of image staining in consecutive color toning.

Toner resins: U.S. Pat. No. 3,806,430 to Sato et al. describes the use of thermosetting binder resins such as polyisocyanate-cured alkyd resins, epoxy ester resins and copolymers of a vinyl monomer and styrene, acrylic and methacrylic esters or the like, alkyd resins cured with melamine formaldehyde, or benzoguanimine formaldehyde, drying oil modified alkyd resins, and epoxy ester resins cured with a catalyst. U.S. Pat. No. 3,779,924 to Chechak describes alkyd and modified alkyd resins (e.g., soya oil-modified and linseed oil-modified alkyds) and phenolic and modified phenolic resins (phenol formaldehyde resins and derivatives thereof). U.S. Pat. No. 4,845,003 to Kiriu et al. describes the use of acrylic, styrene-butadiene, epoxy, and polyester resins. U.S. Pat. No. 3,345,293 to Bartoszewicz et al. describes a rosin-modified phenol-formaldehyde resin, a polystyrene-based resin, and an epoxy resin. U.S. Pat. No. 3,411,936 to Roteman et al. describe resinous binders that are preferably "substantially uncharged" (col. 2, line 70). U.S. Pat. No. 3,788,995 to Stahly et al. describe toner resins containing polar moieties such as sulfoalkyl acrylate, sulfoalkyl methacrylate, and the like. U.S. Pat. No. 4,229,513 to Merrill et al. describes halogenated polymers designed to serve as negatively charged binder resins. U.S. Pat. No. 4,762,764 to Ng et al. describe thermoplastic toner resins such as poly(methyl methacrylate), poly(methyl acrylate), poly(ethyl methacrylate), and the like.

Surface-bound polymers: U.S. Pat. No. 4,925,766 to Elmasry et al. describes a developer composition in which ion exchange polymers are bound to the surface of the dispersed toner particles, and wherein the chelation sites on the polymers are apparently designed to complex with a charge director present in the carrier liquid. U.S. Pat. No. 4,946,753 to Elmasry et al. also describes such ion exchange resins used in conjunction with toner.

SUMMARY OF THE INVENTION

Accordingly, it is a primary object of the invention to address the above-mentioned deficiencies of the prior art.

It is another object of the invention to provide a solvation-based method of providing charge on toner particles in a liquid electrophotographic developer composition.

It is still another object of the invention to provide a solvation-based method for charging toner particles in a liquid electrophotographic developer composition which involves incorporating into the resinous phase of the toner particle a material containing specific salvation sites effective to solvate a selected metal salt used as the charge director.

It is a further object of the invention to provide toner for incorporation into a liquid electro-photographic developer composition, wherein the toner is formulated with a resinous phase containing a material having such specific salvation sites.

It is still a further object of the invention to provide a liquid electrophotographic developer composition containing such a toner and charge director dispersed in an insulating carrier liquid.

Additional objects, advantages and novel features of the invention will be set forth in part in the description which follows, and in part will become apparent to those skilled in the art upon examination of the following, or may be learned by practice of the invention.

The above objects are accomplished in accordance with the present invention by providing a solvation-based method for charging toner particles in a liquid electrophotographic developer composition. The method is premised on the importance of a highly stable, solvated toner particle/charge director complex. In contrast to prior art methods wherein toner particles are charged via simple adsorption of the charge director (see, e.g., Schaffert, supra, at pages 564–566), proton transfer, or ion exchange, the present method involves salvation, that is, charged toner particle complexes are formed by salvation. This is accomplished by incorporating a material containing specific salvation sites into the resinous phase of the toner. The solvation sites and the metal salt which serves as the charge director are both selected so that very stable, charged toner complexes are formed, i.e., complexes of (i) the cationic, metal component of the charge director and (ii) the toner particle itself.

By way of background, solvation of cations such as metal ions is characterized by the formation of well-known aquo-complexes as $$M^{+n}+(r)H_2O \leftrightarrows M^{+n}(H_2O)_r \tag{1}$$

The exothermicity of complex formation and therefore the formation constant is related to the enthalpies of hydration (see Table 1, in Part (B) of the Detailed Description). Although precise thermodynamic values are not readily available for alcohols, carboxylic acids, and the like, a parallel correlation exists. As a consequence, when toner particles are interfaced with specific charge directors, the following equilibrium relationships are believed to be applicable:

$$MX \rightleftharpoons M^+ + X^- \tag{2}$$

$$T{-}OH + M^+ \rightleftharpoons T{-}\overset{\overset{H}{|}}{O}{:}M^+ \tag{3}$$

where $X^-$ is the counterion and T the toner particle. This reaction is the equivalence of hydration of metal ions from the gas phase. That is, the complexation (i.e., charge direction) reaction is driven in solvents of low dielectric by salvation with sites on the toner particle surface. The most preferred solvation reactions should be quite exothermic and are characterized by large negative enthalpy. From inspection of the equation $$\log K = \frac{T\Delta S - \Delta H}{2.3\,RT} \tag{4}$$

as the enthalpy of solvation becomes increasingly negative, the equilibrium constant K for the solvation reaction becomes larger. In other words, the formation of the solvated complex becomes increasingly favorable.

Where ionizable sites are employed on the toner particle, the reaction described in Equation (3) may indeed proceed according to the equation

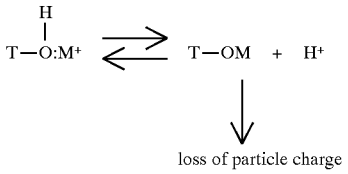

(5)

and result in a loss in developer conductivity and consequent instability. As will be described in further detail hereinbelow, addition of the conjugate acid of the counterion suppresses this event and thus stabilizes the developer.

In a preferred embodiment, the resinous phase of the toner is formulated so that it contains a polymer having the aforementioned solvation sites, which are then present on the surface of the toner particle and thus exposed to and available to solvate charge director in the liquid developer. In an alternative embodiment, the resinous phase of the toner is formulated such that it contains monomeric species with such salvation sites, which may or may not be present in combination with a solvating polymer. Whether the salvation sites are present on a monomeric species, a polymeric species, or both, it must be emphasized that preferred solvating materials are those which will exothermically solvate the cationic component of the charge director so as to maximize the stability of the resulting charged toner complex and minimize the presence of free, unassociated charge director in solution. Solvation may take place without any significant ionization of the solvation sites.

In another aspect of the invention, toner is provided which contains, in its resinous phase, a material containing specific salvation sites as just described.

In still another aspect of the invention, a developer composition is provided which contains such toner particles dispersed in an insulating carrier liquid together with a selected metal salt to serve as the charge director.

Other aspects of the invention include: processes for manufacturing the above-described toner and developer compositions; consecutive color toning processes making use of solvation-based charge direction; and an electrophotographic image constituting a composite color print prepared using the methods and compositions which will be described in detail herein.

DETAILED DESCRIPTION OF THE INVENTION

A. Definitions

"Toner" as used herein is intended to denote the resinous, colored particles (referred to sometimes herein as "toner particles") which ultimately form the electrophotographic image on the photoconductive (pc) surface.

By "developer composition" as used herein is meant a dispersion of toner and charge director in a selected insulating carrier liquid. The developer composition may contain a number of additional components as will be described below.

"Particle-mediated" conductivity and charge is intended to mean that virtually all of the conductivity and charge in a developer composition derive from the charged toner particles and not from free, unassociated salts which may be present in solution (i.e., from unassociated charge director or other ionizable species). The developer compositions of the invention display very high particle-mediated conductivity and charge and very low continuous phase conductivity.

"Consecutive color toning" as used herein is intended to mean an electrophotographic development process involving repetition of charging and development steps with more than one color (as outlined in the Background Section above) so as to provide a multicolor final image. The process is also sometimes referred to herein as "consecutive multicolor image development".

"Background staining" is a problem which can arise in any electrophotographic process. As used herein the term has its art-recognized meaning and refers to the problem wherein toner appears in unintended, uncharged, non-image areas.

"Image staining" is a problem which is specific to consecutive color toning, and similarly has its art-recognized meaning as used herein. The problem involves overtoning by a second or subsequent process color of an earlier color image in regions where portions of the earlier image should have been discharged but were not. "Image staining" is also sometimes referred to herein and in the art as "character staining".

By "specific salvation sites" is meant moieties present in a material contained within the toner resin and effective to solvate the metal salt or salts which will serve as the charge director. "Solvation" is used according to its conventional meaning, i.e., to indicate the association or combination of a solute unit (the charge director, in the present case) with a solvent species (the salvation sites on the toner surface herein). See, e.g., *The McGraw-Hill Encyclopedia of Science and Technology*, New York: McGraw-Hill, 1987. As discussed therein, salvation may involve chemical or physical interaction, or both, and may vary in degree from a loose complex to a distinct, tightly complexed structure. In the present invention, the solvation sites in the charge director are preferably selected such that solvation of the charge director is a highly exothermic process and gives rise to a very stable, charged toner particle.

By "carboxyl" as used herein is meant the carboxylic acid moiety —COOH.

B. Overview of the Novel Method

As noted above, the focus of the present invention is on a solvation-based mechanism for providing charge on toner particles contained in a liquid electrophotographic developer composition.

The present invention thus involves a novel method of creating very stable charge director/toner complexes. As explained in U.S. Pat. No. 5,411,833 incorporated by reference above, the stability of the charge director/toner complex has been found to be of the utmost importance in liquid electrophotography. In the '933 patent, the focus was on the use of toners containing surface ion exchange sites effective to form extremely stable, ionic complexes with the metal salts that serve as the charge director. In the present application, the focus is on a salvation interaction, i.e, the cationic, metal component of the charge director is complexed via salvation to the surface of the toner particle. As explained in the '833 application, if the toner and the cationic component of the charge director are such that complexation between the two components is heavily favored, as here, virtually all of the charge director will be present in complexed form, and there will be substantially no unassociated charge director in solution. In the present case, the solvation sites and the charge director are selected such that solvation is a highly exothermic process, giving rise to an extremely stable complex. Examples of particular toner materials and charge directors which may be used in this manner, to provide an extremely stable charged toner particle, are set out in Part (C) of this section.

In general, the salvation sites may derive from one or more polymers and/or one or more monomeric species incorporated into the toner resin. Indeed, the toner resin itself may be a polymer containing the desired salvation sites. Exceptional salvation sites are those which, as noted above, will not ionize to any significant degree under the conditions of ordinary storage and use of the liquid electrophotographic developer. If ionizable salvation sites are present, e.g., carboxyl groups, it is preferred that the charge director be either a pH-neutral salt (i.e., a metal salt of a strong acid) or a salt that contains a self-stabilized counterion, as will be described in the next section. Also, if such ionizable moieties are used as solvation sites, it is preferred that a small amount of acid, preferably the acid form of the charge director's counterion, be added into the developer composition to force equilibrium towards the non-ionized form of the species (in the case of a carboxyl group, the added acid will thus give rise to COOH groups as opposed to the ionized $COO^-$ species).

The charge director should also be selected with a view towards maximizing the stability of the "solvated" charged toner particle complex. More specifically, the charge director should be a metal salt containing a metal ion which will give rise to a highly exothermic salvation interaction with the aforementioned solvation sites. The preferred metals are generally those which have large negative enthalpies of hydration. The following table illustrates the enthalpies of hydration of some ions:

Enthalpies of Hydration* of Some Ions (kJ $mol^{-1}$)

| | | | | | |
|---|---|---|---|---|---|
| $H^+$ | −1091 | $Ca^{2+}$ | −1577 | $Cd^{2+}$ | −1807 |
| $Li^+$ | −519 | $Sr^{2+}$ | −1443 | $Hg^{2+}$ | −1824 |
| $Na^+$ | −406 | $Ba^{2+}$ | −1305 | $Sn^{2+}$ | −1552 |
| $K^+$ | −322 | $Cr^{2+}$ | −1904 | $Pb^{2+}$ | −1481 |
| $Rb^+$ | −203 | $Mn^{2+}$ | −1841 | $Al^{2+}$ | −4665 |
| $Cs^+$ | −264 | $Fe^{2+}$ | −1946 | $Fe^{3+}$ | −4430 |
| $Ag^+$ | −473 | $Co^{2+}$ | −1996 | $F^-$ | −515 |
| $Tl^+$ | −326 | $Ni^{2+}$ | −2105 | $Cl^-$ | −381 |
| $Be^{2+}$ | −2494 | $Cu^{2+}$ | −2100 | $Br^-$ | −347 |
| $Mg^{2+}$ | −1921 | $Zn^{2+}$ | −2046 | $I^-$ | −305 |

*Absolute values are based on the assignment of −1091 ± 10 kJ $mol^{-1}$ to $H^+$ (cf. H. F. Halliwell and S. C. Nyburg, Trans. Faraday Soc., 1963, 59:1126). Each value probably has an uncertainty of at least 10 n kJ $mol^{-1}$, where n is the charge of the ion.

(F. A. Cotton and G. Wilkinson, *Advanced Inorganic Chemistry*, New York: John Wiley & Sons, 1972.)

The present invention involves solvation by materials other than water, and thus does not involve hydration as such. Enthalpies of solvation will, however, typically correlate with these enthalpies of hydration. The enthalpy of solvation here (i.e., of the cationic, metal component of the charge director by the solvation sites) is generally a large negative value (i.e., the salvation reaction involves an enthalpy of salvation that is more negative than about −50 kJ/mole, preferably more negative than about −100 kJ/mole, most preferably more negative than about −500 J/mole). As may be deduced from the above table, small, highly charged metal ions give rise to the most exothermic hydration or salvation reactions. (See the CRC Handbook of Chemistry and Physics, 67th Ed., at page F-157.) Such metals are, accordingly, preferred charge directors for use in conjunction with the present invention.

Selection of toner salvation sites and a charge director that will give rise to a very stable toner/charge director complex in turn enables preparation of a liquid developer composition in which (1) virtually all of the solution's conductivity and charge derives from the toner particles, (2) the toner is highly charge-stabilized, i.e., will retain charge over a prolonged period of time, and (3) the toner particles are themselves highly charged. As emphasized throughout this application, these features yield a final image of exceptionally high quality, i.e., with respect to image density, edge acuity, and the like, and also enable use of the toner in a consecutive color process without need for intermediate processing steps which have heretofore been necessary to remove residual toner in unwanted, "non-image" areas.

C. Novel Toner and Developer Compositions

In addition to the aforementioned method, the present invention encompasses novel toner and developer compositions. The novel toner is useful for formulating a liquid developer composition in which conductivity and charge are both substantially particle-mediated, as explained above. As with currently available toner compositions, the toner of the invention includes two basic components: (a) resin; and (b) colorant. In contrast to the toners of the prior art, however, the present invention involves, as noted above, the incorporation of a material containing specific salvation sites into the resinous phase of the toner particle.

Materials which may be incorporated into the resinous phase of the toner particle, as discussed in the preceding section, may be either monomeric or polymeric or both.

Preferred monomeric species are those which contain polar moieties as the salvation sites, e.g., sulfhydryl groups, amines, or oxygenic moieties such as hydroxyl groups, carboxyl groups, ketones, amides, and ethers. Most exceptional, however, are hydroxyl-containing monomeric species. Examples of monomeric species which may be incorporated into the toner resin to provide such specific salvation sites include sugars, e.g., mannitol, sorbitol, xylitol and the like.

It is generally preferred herein that the material containing specific salvation sites be polymeric. Preferred polymers, like preferred monomers, are those which contain as the specific solvation sites hydroxyl groups, sulfhydryl groups, carboxyl groups, ketones, amides, ethers, and/or amines. An example of a class of polymers useful herein which contain ketone moieties as the specific salvation sites are acrylates. An example of an amide-containing polymer is nylon, while an exemplary ether-containing polymer is polyethylene oxide. An example of an amino-containing polymer for use herein is polyvinyl pyridine. Examples of particularly preferred polymers for use herein are ethylene-acrylic acid copolymers, ethylene-vinyl alcohol copolymers, styrene-allyl alcohol copolymers, cellulose acetate-butyrate copolymers, hydroxyalkyl acrylate copolymers, and ionomers and mixtures thereof. It will be appreciated by those skilled in the art, however, that a wide range of polymeric materials may be used herein, so long as the selected material enables salvation of the charge director to give a highly stable toner/charge director complex, and does not interact in a deleterious manner with any of the other components of the developer composition.

It is generally preferred that the materials containing specific salvation sites be non-ionized under the conditions used in electrophotographic development, i.e., such that at least about 80%, more preferably at least about 90%, and most preferably at least about 95%, of the salvation sites are not ionized during ordinary conditions of storage and use. Where the salvation sites are readily ionizable species, such as carboxyl groups, again, as noted above, it is preferred that additional acid be included in the developer composition so that the ionization of the carboxyl groups is suppressed. Typically, this will involve adding the acid form of the charge director counterion. For example, where the charge director counterion is diisopropylsalicylate (DIPS), one would add a sufficient quantity of diisopropylsalicylic acid to force the equilibrium to the point where the carboxylic acid groups are in substantially un-ionized form. Thus, for the preferred classes of charge conductors discussed below which are metallic salts of organic acids, the corresponding organic acid would typically be added for this purpose.

As will be pointed out below, it is also desirable, to ensure the formation of a stable toner/charge director complex, that the metal ion which serves as the cationic component of the charge director is one that will be solvated exothermically by aforementioned material, e.g., aluminum, magnesium, chromium, iron, or the like. Preferred metals are those which have very negative enthalpies of hydration and thus, herein, give rise to an enthalpy of salvation that is more negative than about −500 kJ/mol, more preferably more negative than about −1000 kJ/mol. Such values will give rise to a charged toner complex which is extremely stable, in turn enabling preparation of a liquid developer composition having a virtually indefinite shelf-life. This aspect of the invention represents a tremendous advantage relative to currently available developer compositions, which can be relatively unstable and have a finite shelf-life.

The colorants which may be used in the toner can include virtually any pigments, dyes or stains which may be incorporated in the toner resin and which are effective to make visible the electrostatic latent image. Examples of suitable colorants include: Phthalocyanine blue (C.I. 74160), Diane blue (C.I. 21180), Milori blue (an inorganic pigment equivalent to ultramarine) as cyan colorants; Brilliant carmine 6B (C.I. 15850), Quina-cridone magenta (C.I. Pigment Red 122) and Thio indigo magenta (C.I. 73310) as magenta colorants; benzidine yellow (C.I. 21090 and C.I. 21100) and Hansa Yellow (C.I. 11680) as yellow colorants; organic dyes; and black materials such as carbon black, charcoal and other forms of finely divided carbon, iron oxide, zinc oxide, titanium dioxide, and the like. It should also be noted that the polymers for use in conjunction with the present invention tend to dissolve the aforementioned pigments and dyes readily and are thus quite advantageous in that regard.

The developer compositions of the invention contain the aforementioned toner, together with a selected charge director, as described above, dispersed in an insulating carrier liquid.

One class of metal salts useful as charge directors herein is described in U.S. Pat. No. 5,411,833, filed 16 Jan. 1990, incorporated by reference above. Those charge directors include as a counterion the intramolecularly stabilized anion of an ortho-hydroxy aromatic acid, e.g., salicylic acid or a derivative thereof. By a salicylic acid "derivative" applicant intends to include salicylic acid substituted with one to four, typically one to two, substituents independently selected from the group consisting of lower alkyl (1–6C), lower alkoxy (1–6C), halogen, amino, hydroxy, nitro and sulfonate.

These charge directors may typically be represented by the formula $(RO^-)_xM^{+n}(AA^-)_y$ in which M is a metal atom, $AA^-$ represents the anion of the ortho-hydroxy aromatic acid, and R is selected from the group consisting of R'CO—, $C_1$–$C_{15}$ alkyl, and a 1–3 ring aryl moiety optionally substituted with 1–6 carbon atom alkyl substituents, where R' is $C_1$–$C_{14}$ alkyl, n is 2, 3 or 4, and x and y are integers the sum of which, clearly, is n. The metal atom "M" may be divalent, trivalent or tetravalent, with those metal atoms that will coordinate most strongly with the toner resin being preferred. (In one particularly exemplary embodiment, $AA^-$ is diisopropyl salicylate (DIPS), R is $C_{10}H_{21}CO$— (i.e., R' is $C_{10}H_{21}$), n is 3, x is 1 or 2, and y is 1 or 2.)

A second class of charge directors useful herein is described in detail in U.S. Pat. No. 5,153,090, also incorporated by reference. These charge directors are of the formula $(X^-)_aM^{+n}(AA^-)_b$ in which M is a metal atom as described above, $AA^-$ represents the anion of an ortho-hydroxy aromatic acid as described with regard to the charge directors of U.S. Pat. No. 5,411,833, $X^-$ represents the anion of an α,β-diketone, n is 2, 3 or 4, and a and b are integers the sum of which is equal to n, with the proviso that neither a nor b is 0.

As described in U.S. Pat. No. 05/153,090, the anion $X^-$ represents the anion of an α,β-diketone, one which preferably has the formula:

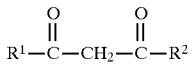

wherein $R^1$ and $R^2$ are independently selected from the group consisting of hydrogen, alkyl, alkenyl, alkynyl, cycloalkyl, haloalkyl, aryl, alkaryl, and haloaryl. If alkyl, alkenyl, alkynyl, cycloalkyl, or haloalkyl, the substituent preferably contains from about 1 to about 12 carbon atoms, more preferably from about 1 to about 6 carbon atoms (wherein the latter type of moiety is sometimes referred to herein as "lower" alkyl, akenyl, alkynyl, etc.). If aryl, alkaryl, or haloaryl, the substituent preferably contains one to about three rings, more preferably, one to two rings, and most preferably is monocyclic. An example of a particularly preferred α,β-diketone is acetyl acetone, i.e., wherein $R^1$ and $R^2$ are both methyl.

The developer compositions of the invention contain toner and developer dispersed in an electrically insulating carrier liquid as well-known in the art. The liquid is typically oleophilic, stable under a variety of conditions, and electrically insulating. That is, the liquid has a low dielectric constant and a high electrical resistivity so as not to interfere with development of the electrostatic charge pattern. Preferably, the carrier liquid has a dielectric constant of less than about 3.5, more preferably less than about 3, and a volume resistivity greater than about $10^9$ ohm-cm, more preferably greater than about $10^{10}$ ohm-cm. Examples of suitable carrier liquids include halogenated hydrocarbon solvents such as carbon tetrachloride, trichloroethylene, and the fluorinated alkanes, e.g., trichloromonofluoromethane and trichlorotrifluoroethane (sold under the trade name "Freon" by the DuPont Company); acyclic or cyclic hydrocarbons such as cyclohexane, n-pentane, isooctane, hexane, heptane, decane, dodecane, tetradecane, and the like; aromatic hydrocarbons such as benzene, toluene, xylene, and the like; silicone oils; molten paraffin; and the paraffinic hydrocarbon solvents sold under the names Isopar G, Isopar H, Isopar K and Isopar L (trademarks of Exxon Corporation). The foregoing list is intended as merely illustrative of the carrier liquids which may be used in conjunction with the present invention, and is not in any way intended to be limiting.

C. Toner and Developer Manufacture

Toner is prepared by admixing resin and colorant at an elevated temperature, followed by dry comminution. The intermediate particles so provided are then subjected to liquid attrition to give the final toner particles. The following exemplifies such a process:

Resin and colorant are admixed at a temperature in the range of about 70° C. to 200° C. A two-roll mill, an extruder, an intensive mixer or the like, is used to ensure complete mixing. The admixture is then comminuted dry, i.e., without addition of liquid, to give intermediate particles typically averaging 30 mils in diameter or less. This dry comminution step is carried out in a jet mill, a hammer mill, or the like. The intermediate particles so obtained are then subjected to liquid attrition in a selected attrition liquid to give the final toner particles. The liquid used for attrition is typically selected from the same class of liquids useful as the carrier liquid for the developer composition, as will be described below.

The developer compositions of the invention—prepared by dispersion of toner and charge director in the insulating carrier liquid—can contain additional materials, e.g., an incompatible phase such as a wax, which is preferably incorporated into the toner at the initial stage of manufacture, i.e., admixed with the colorant, resin, etc., in step (a) (see related U.S. Pat. No. 5,411,833). The developer can also contain an antistain agent to reduce the problem of background staining, as discussed in the parent application hereto; again, the antistain agent is preferably incorporated into the composition at the stage of toner manufacture. The developer composition can also contain other materials as known in the art, e.g., dispersants, stabilizers and the like.

D. Consecutive Multicolor Image Development

Briefly, a consecutive multicolor image development process (or a "consecutive color toning" process) using the materials of the invention may be carried out as follows.

The surface of a photoconductive insulating layer on a relatively conductive substrate is charged, and an initial electrostatic charge pattern (or "latent image") is formed on that surface by exposure through a colored transparency. This latent image is then developed with a liquid developer composition of a first color, i.e., comprising toner formulated with a first colorant, typically yellow. The photoconductive layer is then discharged, either optically or non-optically, i.e., via a corona. These steps are then repeated in sequence with developer compositions of different colors, typically (in order) magenta, cyan and black, at which point the developed image may, if desired, be transferred to another substrate, e.g., paper. Using the toner and developer compositions of the invention, i.e., compositions which involve a solvation interaction between the surface of the toner particles and the incorporated charge director, it is possible to carry out the aforementioned sequence of steps without any intermediate processing steps, i.e., rinsing, drying or the like. These steps have typically been necessary in the prior art, as exemplified by the Alexandrovich et al. patent, cited supra, to address the problem of image staining.

As illustrated by the above disclosure and the examples which follow, the compositions and processes of the invention address and overcome a number of significant obstacles heretofore present in color electrophotographic image development.

The following examples illustrate preparation and use of materials in conjunction with the compositions and processes of the invention.

EXAMPLE 1

Two hundred and twenty-five g of RJ-100 (a styrene-allyl alcohol copolymer obtained from Allied Chemical Corp., Morristown, N.J.) were melted at 95° C. on a two-roll mill. To the polymer melt was added 32 g of Heliogen Blue, 3 g of Pigment Green 7 and 0.9 g of Sicofast Yellow D-1155. Mixing was done in 30 minutes, at which time 10 g of carnauba wax was added. After an additional 15 minutes of mixing the mill was cooled and the resultant product was removed. This mixture was cryogenically comminuted on a hammer mill. Thirty g of this powder were charged into an attritor with 130 g of Isopar G (Exxon). After 45 minutes, the attrition was terminated, discharged from the attritor and diluted with 130 g of Isopar to give a 10% concentrate.

Forty g of the above concentrate was diluted to 400 g with Isopar G to give 1% working developer. To the latter was added 0.4 g of a 1% solution of aluminum diisopropyl salicylate. The developer thus prepared exhibited a stable conductivity of 4.1 pmhos, and also exhibited an excellent shelf-life. This positively charged developer produced sharp, dense images on ZnO photoconductors.

EXAMPLE 2

The procedure of Example 1 was repeated, except that RJ-100 was replaced with ACX 260, an ethylene vinyl acetate/vinyl alcohol copolymer (obtained from Allied Chemical Corp.). Substantially the same results—with respect to stable conductivity, shelf-life, and image quality—were obtained.

EXAMPLE 3

The procedure of Example 1 was repeated, except that the charge director used, instead of aluminum diisopropyl salicylate, was chromium octoate. Substantially the same results—with respect to stable conductivity, shelf-life, and image quality—were obtained.

EXAMPLE 4

The procedure of Example 1 was repeated, except that the charge director used, instead of aluminum diisopropyl salicylate, was aluminum tri-neodecanoate (Mooney Chemical). Substantially the same results—with respect to stable conductivity, shelf-life, and image quality—were obtained.

EXAMPLE 5

The procedure of Example 1 was repeated, except that the charge director used, instead of aluminum diisopropyl salicylate, was copper octoate (Mooney Chemical). Substantially the same results—with respect to stable conductivity, shelf-life, and image quality—were obtained.

EXAMPLE 6

The procedure of Example 1 was repeated, except that the charge director used, instead of aluminum diisopropyl salicylate, was ferric octoate (Mooney Chemical). Substantially the same results—with respect to stable conductivity, shelf-life, and image quality—were obtained.

EXAMPLE 7

The procedure of Example 1 was repeated, except that the charge director used, instead of aluminum tri-neodecanoate, was aluminum dinonylnaphthalene sulfonate. Substantially the same results—with respect to stable conductivity, shelf-life, and image quality—were obtained.

EXAMPLE 8

The procedure of Example 1 was repeated, except that the charge director used, instead of aluminum diisopropyl salicylate, was $Al(AcAc)(DIPS)_2$, wherein "AcAc" represents acetyl acetonate, and "DIPS" represents diisopropyl salicylate.

This charge director was prepared as follows. Aluminum acetyl acetonate (Aldrich Chemical Co., 6.4 g; 0.2 mL) and 8.88 g of diisopropyl salicylic acid (Aldrich Chemical Co.) were dissolved in 100 g of toluene. The resultant solution was heated at 95°–100° C. for 2 hours. The solvent was removed at 95° C. (steambath) in vacuo, leaving 11.3 g of a viscous glass. The latter was dissolved in 25 mL of hot acetone. Upon removal of the acetone in vacuo, a brittle foam resulted which was dried at 70° C. for 24 hours. For the product $C_{31}H_{41}O_8Al$, [Al(AcAc)(DIPS)$_2$], the theoretical percentage of Al is 4.75, while 4.73 was found. The product was readily soluble in Isopar and conferred a positive charge to toners at the rate of $10^{-7}$–$10^{-5}$ mole/g toner.

When used in the process described in Example 1, substantially the same results—with respect to stable conductivity, shelf-life, and image quality—were obtained.

EXAMPLE 9

One hundred seventy-five g of ACX 251 (an ethylene-vinyl alcohol polymer obtained from Allied Chemical) was melted at 90° C. on a two-roll mill. To the polymer melt was added 31.4 g of Heliogen Blue L 7080, 2.9 g of Heliogen Green (Pigment Green 7), 0.8 g of Sicofast D-1155, and 6.6 g of WB-11, a cationic wax dispersant (Petrolite). Mixing was continued for 30 minutes. The mill was cooled and the product removed and processed to a 10% concentrate as described in Example 1.

To 400 g of 1% working developer was added 0.6 g of a 1% solution of aluminum tri-neodecanoate (Mooney Chemical). The conductivity was 7.8 pmhos. As in Example 1, the shelf-life of the developer was quite superior. This positively charged developer yielded excellent, dense, high resolution images on ZnO photoconductors.

EXAMPLE 10

The procedure of Example 9 was repeated, except that the charge director used, instead of aluminum tri-neodecanoate, was aluminum diisopropyl salicylate. Substantially the same results—with respect to stable conductivity, shelf-life, and image quality—were obtained.

EXAMPLE 11

The procedure of Example 9 was repeated, except that the charge director used, instead of aluminum tri-neodecanoate, was zirconium di-neodecanoate (Mooney Chemical). Substantially the same results—with respect to stable conductivity, shelf-life, and image quality—were obtained.

EXAMPLE 12

The procedure of Example 9 was repeated, except that the charge director used, instead of aluminum tri-neodecanoate, was ferric tri-naphthenate (Nuodex). Substantially the same results—with respect to stable conductivity, shelf-life, and image quality—were obtained.

EXAMPLE 13

The procedure of Example 9 was repeated, except that the charge director used, instead of aluminum tri-neodecanoate, was Al(AcAc)(DIPS)$_2$, wherein "AcAc" and "DIPS" are defined above. The charge director was prepared as described in Example 8.

When used in the process described in Example 8, substantially the same results—with respect to stable conductivity, shelf-life, and image quality—were obtained.

EXAMPLE 14

One hundred twenty g of AC 201 resin (Allied Chemical) were placed onto a two-roll mill at 100° C. To the polymer melt was added 52 g of Sicofast D-1155. After 30 minutes of mixing, 60 g of AC 540 resin (Allied) and 60 g of AC 7 (Allied) were added. After 15 minutes of mixing, 10 g of Ethomid HT 60 dispersant (obtained from Akzo) and 13 g of WB-17 dispersant (Petrolite) were added. Mixing was continued for 20 minutes and the product was discharged and processed to give a 10% developer as described in Example 1.

To 400 g of 1% developer was added 1 g of 0.05% aluminum diisopropyl salicylate and 2 g of a 1% solution of diisopropyl salicylic acid. The conductivity was 3.7 pmhos. This developer—which, like the developer compositions of the preceding examples, exhibited a superior shelf-life—produced sharp, dense images on ZnO photoconductors.

EXAMPLE 15

The procedure of Example 14 was repeated, except that the charge director used, instead of aluminum diisopropyl salicylate, was Al(AcAc)(DIPS)$_2$, wherein "AcAc" and "DIPS" are defined above. The charge director was prepared as described in Example 8.

When used in the process described in Example 30, substantially the same results.

EXAMPLE 16

The procedure of Example 14 is repeated, except that Sicofast D-1155 is replaced with Hostaperm Red E5B-02. Substantially the same results—with respect to stable conductivity, shelf-life, and image quality—were obtained.

EXAMPLE 17

The procedure of Example 14 is repeated, except that Sicofast D-1155 is replaced with Heliogen Blue L-7080. Substantially the same results—with respect to stable conductivity, shelf-life, and image quality—were obtained.

EXAMPLE 18

The procedure of Example 14 is repeated, except that Sicofast D-1155 is replaced with Novaperm Yellow FGL. Substantially the same results—with respect to stable conductivity, shelf-life, and image quality—were obtained.

EXAMPLE 19

The procedure of Example 14 is repeated, except that Sicofast D-1155 is replaced with Indofast Brilliant Scarlet R-6335. Substantially the same results—with respect to stable conductivity, shelf-life, and image quality—were obtained.

EXAMPLE 20

The procedure of Example 14 is repeated, except that Sicofast D-1155 is replaced with Quindo Magenta RV6832. Substantially the same results—with respect to stable conductivity, shelf-life, and image quality—were obtained.

EXAMPLE 21

The procedure of Example 14 is repeated, except that Sicofast D-1155 is replaced with Quindo Red 6713. Substantially the same results—with respect to stable conductivity, shelf-life, and image quality—were obtained.

I claim:

1. A process for providing positive surface charge on toner particles for use in a liquid electrophotographic developer composition, comprising preparing, in an oleophilic, electrically insulating carrier liquid, a dispersion of: (a) toner particles comprising a resinous phase containing a colorant, the particles being formed by admixing the resinous phase and the colorant at a temperature in the range of about 70° C. to 200° C. followed by comminuting the admixture, and (b) a charge director comprising a metal salt having a metal ion selected from aluminum, chromium and ferric and including as a counterion, the anion of an ortho-hydroxy aromatic acid, wherein the resinous phase comprises a monomeric or a polymeric material having specific polar group solvation sites that complex with metal ions of the metal salt and comprise solvation sites consisting of hydroxyl groups, and wherein said charge director and the specific solvation sites are selected such that solvation thereof by the material is an exothermic reaction with a ΔH that is more negative than about −50 kJ/mole, whereby to form by solvation complexes of the metal ions with the hydroxyl group solvation sites of the material.

2. The process of claim 1, wherein the polymer is selected from the group consisting of ethylene-vinyl alcohol copolymers, styrene-allyl alcohol copolymers, cellulose acetate-butyrate copolymers, hydroxyalkyl acrylate copolymers, and ionomers and mixtures thereof.

3. The process of claim 1, wherein the charge director is selected such that solvation thereof by the material is an exothermic reaction with a ΔH that is more negative than about −100 kJ/mole.

4. The process of claim 1, wherein the charge director is selected such that salvation thereof by the material is an exothermic reaction with a ΔH that is more negative than about −500 kJ/mole.

5. A process as in claim 1 and wherein said charge director further comprises a salicylic acid anion or a salicylic acid derivative anion in which the salicylic acid is substituted with one to four substitutents independently selected from the group consisting of lower alkyl having from 1 to 6 carbons, lower alkoxy having from 1 to 6 carbons, halogen, amino, hydroxy, nitro and sulfonate.

6. A process as in claim 1 and wherein said charge control agent has the formula $(RO^-)_xM^{+n}(AA^-)_y$ in which:

M is a metal atom selected from aluminum, chromium and iron;

$AA^-$ represents an ortho-hydroxy aromatic acid anion

R is selected from the group consisting of R'CO—, $C_1$–$C_{14}$ alkyl, and a 1–3 ring aryl moiety optionally substituted with 1–6 carbon atom alkyl substituents, where R' is $C_1$–$C_{14}$ alkyl;

n is 2 or 3 where M is chromium and n is 3 where M is aluminum or iron; and x and y are integers the sum of which is equal to n.

7. A process as in claim 1 and wherein the amount of solvation sites which do not ionize during normal storage and use constitute at least 90% of said solvation sites.

8. Positively charged toner complexes comprising: (a) toner particles of a resinous phase containing colorant, the particles being formed by admixing the resinous phase and the colorant at a temperature in the range of about 70° C. to 200° C. followed by comminuting the admixture, associated with (b) a charge director comprising a metal salt having a metal ion selected from aluminum, chromium and ferric and including, as a counterion, the anion of an ortho-hydroxy aromatic acid, wherein the resinous phase comprises a polymeric or a monomeric material having specific polar group solvation sites that complex with metal ions of the metal salt and comprise solvation sites consisting of hydroxyl groups, and wherein the charge director and the specific solvation sites are selected such that solvation of the charge director by the material is an exothermic reaction with a ΔH that is more negative than about −50 kJ/mole and the charge director metal ions form complexes with the hydroxyl group solvation sites of the material.

9. The charged toner complexes of claim 8, wherein the charge director is selected such that solvation thereof by the material is an exothermic reaction with a ΔH that is more negative than about −100 kJ/mole.

10. The charged toner complexes of claim 8, wherein the charge director is selected such that solvation thereof by the material is an exothermic reaction with a ΔH that is more negative than about −500 kJ/mole.

11. An electrophotographic image constituting a composite color print, comprising, deposited on a substrate in a predetermined pattern, a toner complex of claim 8.

12. A charged toner complex as in claim 8 and wherein said charge director further comprises a salicylic acid anion or a salicylic acid derivative anion in which the salicylic acid is substituted with one to four substitutents independently selected from the group consisting of lower alkyl having from 1 to 6 carbons, lower alkoxy having from 1 to 6 carbons, halogen, amino, hydroxy, nitro and sulfonate.

13. A charged toner complex as in claim 8 and wherein said charge director has the formula $(RO^-)_xM^{+n}(AA^-)_y$ in which:

M is a metal atom selected from aluminum, chromium and iron;

$AA^-$ represents an ortho-hydroxy aromatic acid anion

R is selected from the group consisting of R'CO—, $C_1$–$C_{15}$ alkyl, and a 1–3 ring aryl moiety optionally substituted with 1–6 carbon atom alkyl substituents, where R' is $C_1$–$C_{14}$ alkyl;

n is 2 or 3 where M is chromium and n is 3 where M is aluminum or iron; and x and y are integers the sum of which is equal to n.

14. A positively charged electrophotographic liquid developer composition comprising, dispersed in an oleophilic, electrically insulating carrier liquid, (a) toner particles of a resinous phase containing colorant, the particles being formed by admixing the resinous phase and the colorant at a temperature in the range of about 70° C. to 200° C. followed by comminuting the admixture, and (b) a charge director comprising a metal ion selected from aluminum, chromium and ferric and including, as a counterion, the anion of an ortho-hydroxy aromatic acid, wherein the resinous phase is comprised of a polymeric or a monomeric material having specific polar group solvation sites that complex with metal ions of the metal salt and comprise solvation sites consisting of hydroxyl groups, and wherein the charge director and the specific solvation sites are selected such that solvation of the charge director by the material is an exothermic reaction with a ΔH that is more negative than about −50 kJ/mole and the charge director metal ions form complexes with the hydroxyl group solvation sites of the material.

15. The developer composition of claim 14, wherein the polymer is selected from the group consisting of ethylene-vinyl alcohol copolymers, styrene-allyl alcohol copolymers, cellulose acetate-butyrate copolymers, hydroxyalkyl acrylate copolymers, and ionomers and mixtures thereof.

16. The developer composition of claim 14, wherein the colorant comprises an organic dye.

17. The developer composition of claim 14, wherein the colorant comprises a colored pigment.

18. The developer composition of claim 14, wherein the metal ion is present in the form of a metal salt having the formula $(RO^-)_xM^{+n}(AA^-)_y$ in which:

M is a metal atom selected from aluminum, chromium and iron;

$AA^-$ represents an ortho-hydroxy aromatic acid anion

R is selected from the group consisting of R'CO—, $C_1$–$C_{15}$ alkyl, and a 1–3 ring aryl moiety optionally substituted with 1–6 carbon atom alkyl substituents, where R' is $C_1$–$C_{14}$ alkyl;

n is 2 or 3 where M is chromium and n is 3 where M is aluminum or iron; and x and y are integers the sum of which is equal to n.

19. The developer composition of claim 18, wherein M is aluminum and $AA^-$ is diisopropyl salicylate.

20. A liquid developer composition as in claim 14 and wherein said charge director further comprises a salicylic acid anion or a salicylic acid derivative anion in which the salicylic acid is substituted with one to four substitutents independently selected from the group consisting of lower alkyl having from 1 to 6 carbons, lower alkoxy having from 1 to 6 carbons, halogen, amino, hydroxy, nitro and sulfonate.

21. An electrophotographic developer composition as in claim 14 and wherein the amount of solvation sites which do not ionize during normal storage and use constitute at least 90% of said solvation sites.

22. A process for developing an electrostatic charge pattern using a consecutive color toning system, comprising:

(a) forming an initial negative electrostatic charge pattern on a substrate and developing the initial pattern with a positively charged liquid developer composition comprising, dispersed in an oleophilic, electrically insulating carrier liquid, (i) toner particles of a resinous phase containing a first colorant, the particles being formed by admixing the resinous phase and the colorant at a temperature in the range of about 70° C. to 200° C. followed by comminuting the admixture, and (ii) a charge director comprising a metal ion selected from aluminum, chromium and ferric and including, as a counterion, the anion of an ortho-hydroxy aromatic acid, (b) forming a second electrostatic charge pattern on the substrate and developing the second pattern with a positively charged liquid developer composition comprising, dispersed in an oleophilic, electrically insulating carrier liquid, (i) toner particles of a resinous phase containing a second colorant, the particles being formed by admixing the resinous phase and the colorant at a temperature in the range of about 70° C. to 200° C. followed by comminuting the admixture, and (ii) a charge director comprising a metal ion selected from aluminum, chromium and ferric and including, as a counterion, the anion of an ortho-hydroxy aromatic acid, wherein steps (a) and (b) are conducted in immediate succession without any additional processing steps therebetween, wherein the resinous phase comprises a polymeric or a monomeric material having specific polar group solvation sites that complex with metal ions of the metal salt and comprise solvation sites consisting of hydroxyl groups, and wherein the charge director and the specific solvation sites are selected such that solvation of the charge director by the material is an exothermic reaction with a ΔH that is more negative than about −50 kJ/mole and the charge director metal ions form complexes with the hydroxyl group solvation sites of the material.

23. The process of claim 22, further comprising repeating steps (a) and (b) with third and fourth colorants to provide a developed image.

24. The process of claim 23, further comprising transferring the developed image to a surface of a selected substrate so as to give rise to an electrophotographic color print thereon.

25. A process for providing positive surface charge on toner particles for use in a liquid electrophotographic developer composition, comprising preparing, in an oleophilic, electrically insulating carrier liquid, a dispersion of: (a) toner particles comprising a resinous phase containing a colorant; (b) a charge director comprising a metal salt having a metal ion selected from aluminum, chromium and ferric, wherein the resinous phase comprises a monomeric or a polymeric material having a plurality of specific polar group solvation sites that complex with metal ions of the metal salt and comprise solvation sites consisting of the carboxylic acid moiety —COOH, and wherein said charge director and the specific solvation sites are selected such that solvation thereof by the material is an exothermic reaction with a ΔH that is more negative than about −50 kJ/mole; and (c) an organic acid in an amount effective to force the equilibrium of ionization of the carboxyl groups substantially toward the non-ionized form.

26. A process as in claim 25 and wherein the anion of said acid comprises the same anion as an anion of the charge director.

27. Positively charged toner complexes comprising: (a) toner particles of a resinous phase containing colorant, associated with (b) a charge director comprising a metal ion selected from aluminum, chromium and ferric, wherein the resinous phase comprises a polymeric or a monomeric material having specific polar group solvation sites that complex with metal ions of the metal salt and comprise solvation sites consisting of the carboxylic acid moiety —COOH, and wherein the charge director and the specific solvation sites are selected such that solvation of the charge director by the material is an exothermic reaction with a ΔH that is more negative than about −50 kJ/mole, and (c) an organic acid in an amount effective to force the equilibrium of ionization of the carboxyl groups substantially toward the non-ionized form.

28. Toner complexes as in claim 27 and wherein the anion of said acid comprises the same anion as an anion of the charge director.

29. A positively charged electrophotographic liquid developer composition comprising, dispersed in an oleophilic, electrically insulating carrier liquid, (a) toner particles of a resinous phase containing colorant, (b) a charge director comprising a metal ion selected from aluminum, chromium and ferric, wherein the resinous phase is comprised of a polymeric or a monomeric material having specific polar group solvation sites that complex with metal ions of the metal salt and comprise solvation sites consisting of the carboxylic acid moiety —COOH, and wherein the charge director and the specific solvation sites are selected such that solvation of the charge director by the material is an exothermic reaction with a ΔH that is more negative than about −50 kJ/mole and (c) an organic acid in an amount effective to force the equilibrium of ionization of the carboxyl groups substantially toward the non-ionized form.

30. A liquid developer composition as in claim 29 and wherein the anion of said acid comprises the same anion as an anion of the charge director.

31. A process as in claim 29 and wherein said charge control agent has the formula $(RO^-)_xM^{+n}(AA^-)_y$ in which:

M is a metal atom selected from aluminum, chromium and iron;

$AA^-$ represents an ortho-hydroxy aromatic acid anion

R is selected from the group consisting of R'CO—, $C_1$–$C_{15}$ alkyl, and a 1–3 ring aryl moiety optionally substituted with 1–6 carbon atom alkyl substituents, where R' is $C_1$–$C_{14}$ alkyl;

n is 2 or 3 where M is chromium and n is 3 where M is aluminum or iron; and x and y are integers the sum of which is equal to n.

32. A liquid developer composition as in claim 29 and wherein said charge director further comprises a salicylic acid anion or a salicylic acid anion wherein the salicylic acid is substituted with one to four substitutents independently selected from the group consisting of lower alkyl having from 1 to 6 carbons, lower alkoxy having from 1 to 6 carbons, halogen, amino, hydroxy, nitro and sulfonate.

* * * * *